US012522954B2

(12) United States Patent
Verlotski et al.

(10) Patent No.: US 12,522,954 B2
(45) Date of Patent: Jan. 13, 2026

(54) SPINNING OR TWISTING RING, AND RING/TRAVELER SYSTEM

(71) Applicant: Bräcker AG, Pfäffikon-Zürich (CH)

(72) Inventors: Vadim Verlotski, Wuppertal (DE); Markus Dippel, Pfäffikon (CH); Jan-Dirk Gerken, Pfäffikon (CH)

(73) Assignee: Bräcker AG, Pfäffikon-Zürich (CH)

( * ) Notice: Subject to any disclaimer, the term of this patent is extended or adjusted under 35 U.S.C. 154(b) by 0 days.

(21) Appl. No.: 18/705,128

(22) PCT Filed: Oct. 28, 2022

(86) PCT No.: PCT/EP2022/080288
§ 371 (c)(1),
(2) Date: Apr. 26, 2024

(87) PCT Pub. No.: WO2023/073212
PCT Pub. Date: May 4, 2023

(65) Prior Publication Data

US 2025/0243609 A1 Jul. 31, 2025

(30) Foreign Application Priority Data

Nov. 1, 2021 (CH) ..... 70475/2021

(51) Int. Cl.
*D01H 7/60* (2006.01)

(52) U.S. Cl.
CPC ..... *D01H 7/602* (2013.01); *D01H 7/604* (2013.01)

(58) Field of Classification Search
CPC ..... D01H 7/602; D01H 7/604
USPC ..... 57/119, 125
See application file for complete search history.

(56) References Cited

U.S. PATENT DOCUMENTS

| | | | | |
|---|---|---|---|---|
| 2,970,425 | A | 2/1961 | Foard | |
| 3,416,301 | A * | 12/1968 | Kurt | D01H 7/602 57/119 |
| 4,677,817 | A | 7/1987 | Kanai | |
| 6,804,943 | B2 * | 10/2004 | Kagi | D01H 7/604 57/120 |
| 2001/0047645 | A1 * | 12/2001 | Poquette | D01H 7/602 57/125 |

(Continued)

FOREIGN PATENT DOCUMENTS

| | | | | |
|---|---|---|---|---|
| CN | 107 021 752 | A | 8/2017 | |
| CN | 108866697 | A * | 11/2018 | D01H 7/602 |
| CN | 110 527 885 | A | 12/2019 | |

(Continued)

OTHER PUBLICATIONS

Translation of CN 108866697.*

(Continued)

*Primary Examiner* — Shaun R Hurley
(74) *Attorney, Agent, or Firm* — Dority & Manning, P.A.

(57) ABSTRACT

A spinning ring for a ring-spinning or ring-twisting machine includes a web and a ring crown, the ring crown having a contact surface along which a ring traveler slides in operation of the ring-spinning or ring-twisting machine. At least the contact surface of the ring crown formed of a tungsten sintered material having at least 90% tungsten. A ring/traveler system using the spinning ring includes a ring traveler made of a wire made of high-speed steel (HSS) having a minimum hardness of 60 HRC.

11 Claims, 2 Drawing Sheets

(56) References Cited

U.S. PATENT DOCUMENTS

2002/0162315 A1 11/2002 Kagi

FOREIGN PATENT DOCUMENTS

| | | | | | |
|---|---|---|---|---|---|
| DE | 811 092 | C | | 8/1951 | |
| EP | 0 201 602 | A1 | | 11/1986 | |
| EP | 1 066 419 | | | 9/2002 | |
| EP | 3 052 684 | | | 8/2016 | |
| EP | 3643429 | A1 | * | 4/2020 | ..... B22F 1/0011 |
| JP | S 6112853 | A | | 1/1986 | |
| JP | S 61225334 | A | | 10/1986 | |
| JP | S 62161940 | A | | 7/1987 | |
| JP | S 62199822 | A | | 9/1987 | |
| JP | H 059818 | A | | 1/1993 | |
| JP | 2018003135 | A | * | 1/2018 | |

OTHER PUBLICATIONS

Translation of EP 3643429.*
Translation of JP 2018003135.*
PCT Search Report and Written Opinion, Feb. 9, 2023.
CH Search Report, Feb. 21, 2022.

* cited by examiner

SPINNING OR TWISTING RING, AND RING/TRAVELER SYSTEM

BACKGROUND

The invention relates to a ring for a ring-spinning machine or a ring-twisting machine and to a ring/traveler system. Rings are used as spinning rings in so-called ring-spinning machines or as twisting rings in so-called twisting machines. In the following, spinning rings and twisting rings are summarized under the term spinning ring. The spinning rings work together with attached ring travelers. The ring travelers, pulled along by the thread held by the ring traveler, rotate at high speeds on an upper side of the spinning rings, the so-called ring crown, which results in high stresses at the contact surfaces between the ring traveler and the ring crown of the spinning rings. A web adjoining the ring crown is provided for fastening the spinning rings in a machine, and said web can end in a foot flange. The ring crown as well as the foot flange or—if the foot flange is missing, the web—are manufactured in a variety of designs, each adapted in shape and geometry to the requirements of the corresponding machine and of a construction of the fastening means for the spinning ring. The spinning ring is held in the machine in a so-called ring frame.

During operation, the friction surfaces between the spinning ring and the ring traveler heat up, and accordingly so does the thread. The rapid rotation of the ring traveler on the spinning ring can result in local temperatures of over 400° C., which in turn determine operational limits for the ring/traveler system. Given these mechanical properties, for ring diameters that are common at this point in time, ring traveler rotation speeds of more than 30,000 revolutions per minute cannot be exceeded without damage to the ring traveler or to the thread. Along with continued development of the constructions of the spinning ring and the ring traveler, this speed has grown ever greater, and today reaches a maximum of reliable spinning for cotton at about 42 m/s and for polyester at about 32 m/s. The developments in the field of materials have influenced to a small degree the base material of the spinning ring and of the ring traveler—but to a greater degree, their surfaces. The development of the base materials for spinning rings and ring travelers has hardly been considered since the invention of the ring spinning machine in the 19th century. The commonly used material for both components is still a hardened carbon steel. A large number of different coatings for spinning rings and ring travelers have been developed. These have already produced a significant increase in the service life of the components. Nevertheless, it has not been possible to achieve a significant increase in the speed of the ring traveler by means of the coatings. By means of special coatings at least in the region of the contact surfaces, the sliding properties have been improved, and along with them, the service life; however, hardly any increase in the speed of the ring traveler has been achieved.

Various embodiments of coatings of spinning rings or ring travelers are known from the prior art. For example, EP 1 066 419 A1 discloses a traveler coated with phosphate, which achieves a lower wear of the ring traveler on the ring. EP 3 052 684 A1 discloses a spinning ring with a chromium coating with embedded boron nitride. This likewise leads to less wear of the ring traveler. US 2002/0162315 A1 discloses a nitrated traveler. The nitration achieves greater wear resistance and an improvement in the sliding properties. U.S. Pat. No. 4,677,817 A discloses a ring traveler coated with a ceramic in order to reduce the wear and to extend the service life. Furthermore, U.S. Pat. No. 2,970,425 discloses a nickel-coated spinning ring with which a uniform surface, and thus a reduction in the coefficient of friction, can be achieved.

A reduction in wear, as disclosed in the prior art, of one component is relatively easy to achieve. The component (e.g., the spinning ring) must be coated with a layer that is as hard as possible, or can be produced from an extremely hard material. The disadvantage of this is that the other component (e.g., the ring traveler) wears accordingly faster. The temperature of the friction point and/or of the contact surfaces, which is higher in the ring traveler than in the spinning ring, as is accordingly the wear of the ring traveler, is accelerated despite the hardest possible coatings.

SUMMARY OF THE INVENTION

An object of the invention is accordingly to provide a spinning ring that enables a longer service life at the speeds of the ring traveler that are prevalent today, and which makes it possible to increase the upper limit of the speed of the ring traveler.

It is also an object of the invention to provide a ring/traveler system that permits an increase in the speed threshold of the ring traveler to above 50 m/s (cotton).

Additional objects and advantages of the invention will be set forth in part in the following description, or may be obvious from the description, or may be learned through practice of the invention.

The objects are achieved by a spinning ring and by a ring traveler system having the features set forth herein.

A spinning ring for a ring-spinning or ring-twisting machine, having a web and a ring crown, is proposed, wherein the ring crown consists at least partially of a tungsten sintered material with at least 90% tungsten. Partial formation of the ring crown with a tungsten surface achieves a number of advantageous properties compared to surfaces known from the prior art, such as steel, chromium, chromium carbide, nickel/phosphorus, and others. The tungsten grains forming the sintered material have a hardness of about 450 HV. This prevents abrasive wear on harder ring travelers; however, the hardness is high enough to be able to withstand the abrasive wear itself. Nowadays common spinning ring surfaces achieve a hardness of up to 1000 HV, which leads to high wear on ring travelers. Furthermore, the tungsten grains have a high thermal conductivity of approximately 180 W/mK, which is virtually equivalent to double that of conventional materials and coatings. The increased thermal conductivity leads to improved heat dissipation, and thus to an increase in the cooling of the spinning ring surface. The tungsten grains also have a melting temperature of about 3400° C. In contrast, the melting temperature of conventional materials is about 1900° C. The high melting temperature causes a reduction in a tendency toward microwelding, such that the destruction of the sliding surface can be at least delayed.

If the tungsten sintered material is subjected to dry friction, tungsten oxide is formed, which is powdery, soft, easily melted and has a weak adhesion to the base material. This results in a self-lubricating effect that contributes to improving the sliding properties. In contrast, there is no self-lubricating effect resulting from dry friction in conventional coated spinning rings, because, for example in the case of spinning rings coated with chromium, the chromium oxide formed is solid and hard, and forms a strongly adhering continuous coating on the chromium surface.

Under these conditions, the use of spinning rings made of sintered tungsten material has a positive effect on the wear of all known ring travelers. The improvement that can be achieved is of a differing magnitude for different ring traveler surfaces. The lowest improvement is demonstrated when using nickel-plated ring travelers. In the case of non-coated steel ring travelers made of carbon steel, in nitrated ring travelers, and in CVD-coated ring travelers (CrC, TiC coatings), in addition to an improvement in the wear behavior by more than 10-15%, a speed advantage has been achieved as well.

Preferably, the entire ring crown consists of a tungsten sintered material with at least 90% tungsten. This design for the entire ring crown, rather than for a limited insert into the ring crown, simplifies the production of the spinning ring.

In an alternative embodiment, the spinning ring is provided with a foot flange on a side of the web opposite the ring crown. There are different designs of spinning rings-up to and including spinning rings with two ring crowns. The embodiment of the spinning rings having the web or having the web and the foot flange is dependent on a construction of the fastening of the spinning rings in the spinning or twisting machine.

Preferably, the tungsten sintered material is W97Ni2Fe. In principle, all available W/Ni/Fe sintered materials can be used as tungsten sintered alloys. However, it has been shown that the best results can be achieved when the material W97Ni2Fe1 is used at a density of 18.5 g/cm$^3$.

Furthermore, it is advantageous if the foot flange and/or the web consists of copper or a copper alloy. During use as spinning rings, copper or copper alloys result in high thermal conductivity, and also, due to dynamic operation, good flexibility with a corresponding dimensional stability. Furthermore, this also leads to the part of the spinning ring produced from the tungsten sintered material being able to be applied preferably to the ring crown or to the web by a soldering process.

For certain applications, it can be advantageous if the foot flange and/or the web consists of an aluminum bronze, preferably of a nickel aluminum bronze (CuAl10Ni5Fe4). A spinning ring corresponding to such an embodiment according to the invention can be manufactured particularly cost-effectively, and is at the same time distinguished by high corrosion resistance and mechanical strength that does not compromise sufficiently high thermal conductivity. Likewise, such a material pairing increases the optical perceptibility of a ring traveler on a spinning ring, which generally applies to embodiments according to the invention of spinning rings with a foot flange and/or the web made of copper or a copper alloy. Such an increased optical perceptibility simplifies the inspection and, if appropriate, also the replacement of ring travelers.

For certain applications, it can be advantageous if the foot flange and/or the web consists of steel. Spinning rings with good thermal conductivity can be achieved when the foot flange and/or the web consists of carbon steel, in particular 100Cr6. The use of a ferritic stainless steel (1.2083) or a duplex stainless steel (1.4462) for the foot flange and/or the web of certain embodiments of a spinning ring according to the invention is also advantageous.

Preferably, the spinning ring as a whole consists of a tungsten sintered material with at least 90% tungsten. This eliminates the need to produce a spinning ring consisting of several parts and to connect the parts to one another, for example by a soldering process. In the production of the spinning ring made entirely of a tungsten sintered material, there are no fundamental differences between conventional steel spinning rings and spinning rings made of tungsten-sintered alloys, since both are lathed from blanks and/or are produced by machining methods. Even in the case of a spinning ring that is combined from several parts, the finished spinning ring is produced from a previously soldered tubular blank. However, in contrast to spinning rings made of steel, tungsten spinning rings are ready for use directly after lathing, without any need for the usual subsequent production processes such as, for example, curing, scrubbing, polishing and chroming.

Furthermore, a ring/traveler system for a ring-spinning or ring-twisting machine is proposed, wherein a spinning ring according to the above description and a ring traveler made of a wire made of high-speed steel (HSS) are provided, wherein the ring traveler has a minimum hardness of 60 HRC. In order to achieve a maximum increase in the speed of the ring traveler, the wear of the ring traveler must be reduced without triggering an increased wear of the spinning ring, or vice versa. This means that the contact surfaces of the spinning ring and the ring crown, and thus both frictional surfaces, have to be considered and optimized as a pair. This optimization comprises not only an adaptation of the surface hardnesses of the components, but also other aspects, such as, for example, an improvement in heat dissipation from the friction point, or chemical processes that can occur as a result of friction (for example, oxidation). An increase in the rotational speed and/or speed of the ring traveler that is to be achieved by the optimization leads to a corresponding increase in the production of the spinning machine.

The HSS ring traveler can be manufactured from all known high-speed steels that are in the form of a wire. The ring traveler production is analogous to the conventional ring traveler production using carbon steel, with the difference that the processes of annealing, curing, and tempering occur under different conditions. Known hardness parameters typical to the material are to be applied for each HSS material. The basic hardening achieved is in the range of 850-1000 HV, depending on the high-speed steel used. The HSS ring travelers generally do not need a coating, and are ready for use after abrading and polishing.

The advantages of HSS travelers with respect to carbon steel travelers are primarily due to a significantly higher hot hardness. Hardened carbon steels soften quite quickly above about 300° C., whereas hardened high-speed steels retain their original high hardness up to approximately 550° C. During spinning operation, temperatures above 300° C. are common on the ring traveler friction surfaces, and therefore the HSS steels extend the application possibilities for the ring traveler at higher speeds. However, in the temperature range below 300° C., HSS steels also offer significantly higher hardnesses and strengths than carbon steels. Since the high-speed steels are less brittle than carbon steels at maximum hardening, HSS ring travelers can also be more than 200 HV harder than conventional ring travelers at room temperature. A ring traveler of carbon steel must not be harder than 700 HV, because otherwise it fractures when placed on the spinning ring. In contrast, the HSS ring travelers fracture when placed on the spinning ring only if hardened to above approximately 950 HV.

Just like tungsten spinning rings in comparison with conventional spinning rings, the HSS ring travelers are superior to virtually all common carbon steel ring travelers when used in combination with all possible spinning rings. However, in this case as well, the maximum effect was achieved only for the tungsten ring. The following application examples show the speed increase that were achieved in individual cases.

The high-speed steel preferably corresponds to the material 1.3343 according to DIN EN ISO 4957 (2018 November) with the material name HS6•5-2C. Use of this material has proven to be particularly advantageous.

For a combination of the spinning rings made of tungsten sintered material with ring travelers made of high-speed steels (HSS ring travelers), an increase in speed of the ring traveler of more than 20% could be achieved.

The following application examples demonstrate the speed increases that could be achieved in individual cases of combinations of spinning rings, having ring crowns produced at least partially from tungsten sintered material (tungsten spinning rings), with common ring travelers. The listed designations originate from the applicant's product catalog and correspond to commercially available ring travelers:

Before the start of the test series, all spinning rings were run in with corresponding ring travelers at a low speed (23-34 m/s) over several hours. A test series consisted of several identical tests, wherein each further experiment was carried out within a test series at somewhat higher speed (ring traveler rotation speed). The runtime of a test per speed and ring traveler was one hour (a new ring traveler was used for each test). All the ring travelers were weighed before and after the test to detect the degree of wear (measurement accuracy: about 0.01 mg). During the test series, the speed was increased in steps, with a step of 0.6 m/s. As a reference for the comparison, a certain measure for the ring traveler wear was set at 0.2 mg; ring travelers with a wear greater than 0.2 mg were considered to be worn. The maximum possible speed threshold was set for the ring traveler speed at which the first ring traveler of the series was worn in a 60 minute test. In all experiments, no measurable wear of spinning rings was determined. All application examples relate to laboratory tests with a SER.MA.TES 16-spindle spinning machine. In all tests, the new components (tungsten spinning rings and/or HSS ring travelers) were tested simultaneously with geometrically identical reference components from the prior art. As such, a direct comparison was established between old and new components under the same conditions. The combined tungsten spinning rings consisted of a ring crown made of the sintered material W97Ni2Fe1 that was soldered onto a web made of copper. The HSS ring traveler was manufactured from the high speed steel 1.3343 (M2). The maximum achievable ring traveler rotation speed corresponds to the rotation speed at which the same wear on the ring traveler occurs, within the same operating time, as occurs for the reference ring traveler rotation speed for the spinning ring/traveler pairing.

Example 1. A tungsten spinning ring was compared with a chrome-plated steel spinning ring, together with a non-coated ring travelers made of carbon steel.

Type of spinning ring: T-flange rings Ø47×38,

Type of ring traveler: C1ELMudrISO35.5 mg

Spinning parameters: Cotton, Ne 30, twist=1000, not compact.

Reference ring traveler rotation speed for a steel spinning ring: 20,000 rpm (39.8 m/s)

Maximum ring traveler rotation speed for a tungsten spinning ring: 23,300 rpm (46.3 m/s)

This results in a speed—and thus production—increase of 16.3%.

Example 2. A tungsten spinning ring was compared with a chrome-plated steel spinning ring, together with a nitrated ring traveler made of carbon steel.

Type of spinning ring: T-flange rings Ø47×38,

Type of ring traveler: C1SELudrISO31.5 mg,

Spinning parameters: Cotton, Ne 30, twist=922, compact.

Reference ring traveler rotation speed for a steel spinning ring: 22,000 rpm (43.8 m/s), Maximum ring traveler rotation speed for a tungsten spinning ring: 25,300 rpm (50.3 m/s), This results in a speed—and thus production—increase of 14.9%.

Example 3. The use of a tungsten spinning ring with an HSS ring traveler was compared with the use of a chrome-plated steel spinning ring with a non-coated carbon steel ring traveler.

Type of spinning ring: T-flange rings Ø47×38,

Type of ring traveler: C1ELudrISO18.0 mg,

Spinning parameters: Cotton Ne 46, twist=1000, not compact.

Reference ring traveler rotation speed for a steel spinning ring: 22,000 rpm (43.8 m/s), Maximum ring traveler rotation speed for HSS ring travelers on a tungsten spinning ring: 27,000 rpm (53.7 m/s), This results in a speed—and thus production—increase of 22.6%.

Example 4. The use of a tungsten spinning ring with a HSS ring traveler was compared with the use of a chrome-plated steel spinning ring with an uncoated carbon steel ring traveler.

Type of spinning ring: T-flange rings Ø47×38,

Type of ring traveler: C1MMudrISO63.0 mg,

Spinning parameters: Cotton N20, twist=705, not compact.

Reference ring traveler speed: 14,300 rpm (28.4 m/s),

Maximum ring traveler rotation speed for HSS ring travelers on a tungsten spinning ring: 17,300 rpm (34.4 m/s), This results in a speed—and thus production—increase of 21.1%.

BRIEF DESCRIPTION OF THE DRAWINGS

The invention is described below on the basis of an exemplary embodiment and explained in more detail with the drawings. The following are shown.

DETAILED DESCRIPTION

Figure 1:
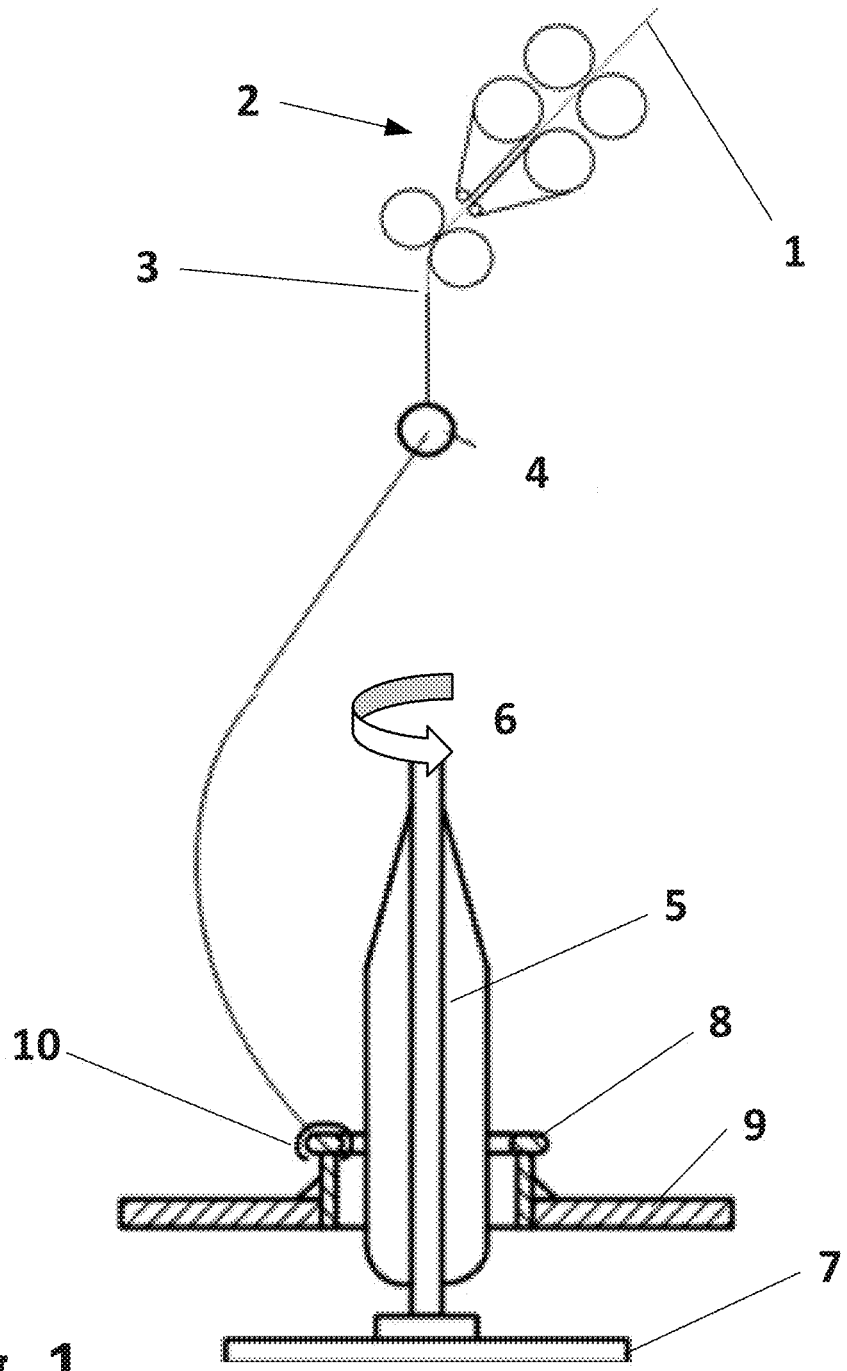
FIG. 1 a schematic illustration of a ring-spinning machine.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic illustration of a spinning position of a ring-spinning machine, wherein current ring-spinning machines have up to 2'000 or more such spinning positions. In the ring-spinning machine, a fiber structure, a so-called roving 1, is fed to a drafting system 2. The roving 1 is drawn into a thread 3 by the drafting system 2. The drafting system 2 shown is a so-called apron drafting system, which is usually used for cotton. Many types of drafting systems 2 are known from the prior art, depending on the application. Downstream of the drafting system 2, the thread 3 is guided to a ring traveler 10 via a thread guide 4. After passing the ring traveler 10, the thread 3 is wound onto the bobbin 5. The bobbin 5 is set in rotation 6 by a drive 7. As a result of this rotation 6 of the bobbin 5, the ring traveler 10 is carried along by the thread 3, which means that the thread 3 is given a rotation and the yarn is thus formed. Because the ring traveler 10 is held on the spinning ring 8, the ring traveler 10 is forced to revolve around the bobbin 5. The spinning ring 8 is held in a stationary manner on a ring frame 9.

Figure 2:
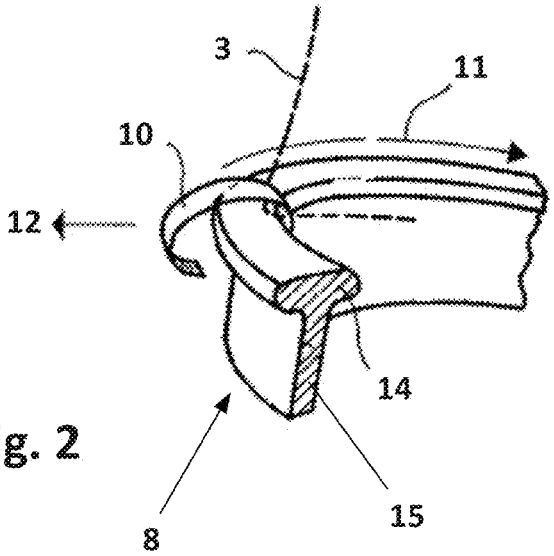
FIG. 2 a schematic illustration of a spinning ring with a ring traveler.

FIG. 2 is a schematic illustration of a spinning ring 8 having a ring traveler 10 placed thereon. The spinning ring 8 illustrated by way of example consists of a ring crown 14 and a web 15 adjoining the ring crown 14. The web 15 serves to fasten the spinning ring 8 in a spinning machine. The ring traveler 10 is placed on the ring crown 14 and surrounds the ring crown 14 in part. In this case, the ring traveler 10 is designed in such a way that it surrounds the ring crown 14 to a sufficient extent that the ring traveler 10 cannot fall off of the ring crown 14; however, the greatest possible freedom of movement of the ring traveler 10 relative to the ring crown 14 is achieved. Numerous forms and embodiments of ring crowns 14 and ring travelers 10 are known from the prior art. The rotational movement transmitted by the thread 3 to the ring traveler 10 causes the ring traveler 10 to revolve around the spinning ring 8 in the direction of the traveler rotation 11. This rotation in turn results in a centrifugal force 12 acting on the ring traveler 10. This presses the ring traveler 10 against the inside of the spinning ring 8 and/or the ring crown 14.

Figure 3:
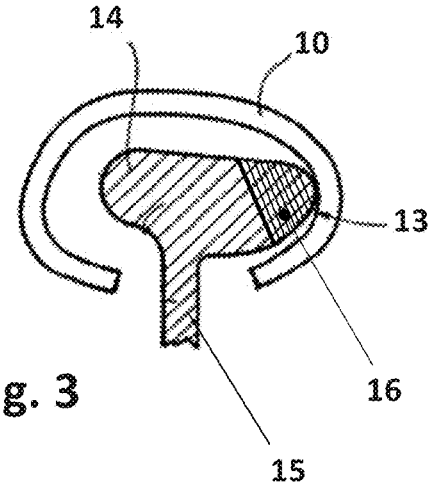
FIG. 3 an enlarged view according to FIG. 2.

This situation is shown enlarged in FIG. 3. The ring traveler 10 slides along the spinning ring 8, thereby engendering a contact surface 13. At least in the region of this contact surface 13, it must be ensured that the ring traveler 10 has good sliding properties relative to the spinning ring 8. By means of a corresponding material selection of the ring crown 14 at least in the region of the contact surface 13, the sliding pairing between the spinning ring 8 and the ring traveler 10 is facilitated. The ring crown 14 is shown in the region of the contact surface 13 with an insert 16 made of a tungsten sintered material having at least 90% tungsten. In this case, the insert is connected to the ring crown by a soldering process on a base material, for example copper.

Figure 4:
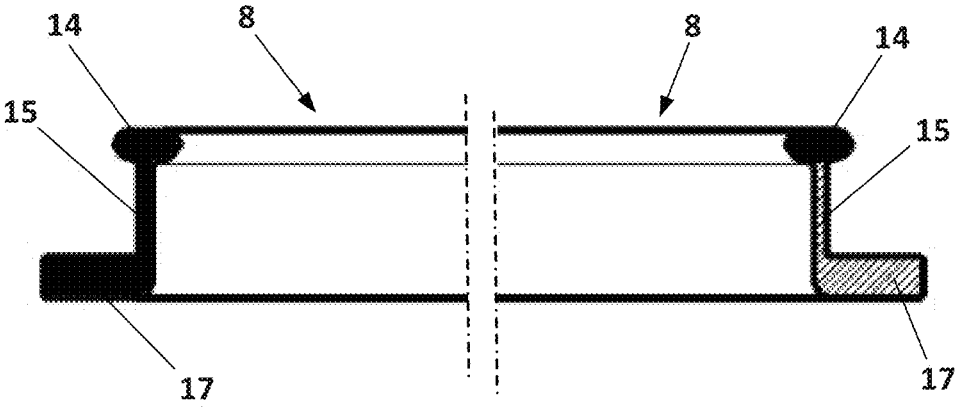
FIG. 4 a schematic illustration of a second and third embodiment of a spinning ring.

FIG. 4 shows a schematic illustration of a second and third embodiment of a spinning ring 8 according to the invention. The illustration is divided into two parts. The designs at left and at right each show a spinning ring 8 with a ring crown 14, a web 15 and a foot flange 17 arranged on a side of the web 15 facing away from the ring crown 14. The foot flange 17 serves to fasten the spinning ring 8 in a spinning machine. In the embodiment at right, the ring crown 14 is made of a tungsten sintered material with at least 90% tungsten, and the remaining part of the spinning ring 8, namely the web 15 and the foot flange 17, are made of a standard material, for example made of copper, a copper alloy, steel or a light metal. The ring crown 14 is connected to the web 15 by a soldering or welding process. In contrast to this, the entire spinning ring 8 in the embodiment at left is made of a tungsten sintered material with at least 90% tungsten.

The present invention is not limited to the embodiments shown and described. Modifications within the scope of the claims are possible as well as a combination of the features, even if these are shown and described in different embodiments.

KEY

1 Roving
2 Drawing frame
3 Thread
4 Thread guide
5 Bobbin
6 Rotation
7 Drive
8 Spinning ring
9 Ring frame
10 Ring traveler
11 Traveler rotation
12 Centrifugal force
13 Contact surface
14 Ring crown
15 Web
16 Insert
17 Foot flange

The invention claimed is:

1. A spinning ring for a ring-spinning or ring-twisting machine, the spinning ring comprising: a web and a ring crown, the ring crown having a contact surface along which a ring traveler slides in operation of the ring-spinning or ring-twisting machine, and the contact surface of the ring crown formed of a tungsten sintered material having at least 90% tungsten.

2. The spinning ring according to claim 1, wherein the ring crown is formed entirely of the tungsten sintered material having at least 90% tungsten.

3. The spinning ring according to claim 1, wherein the tungsten sintered material is W97Ni2Fe1.

4. The spinning ring according to claim 1, further comprising a foot flange on a side of the web opposite the ring crown.

5. The spinning ring according to claim 4, wherein one or both of the foot flange and the web are made of copper or a copper alloy.

6. The spinning ring according to claim 5, wherein the copper alloy is a nickel aluminum bronze.

7. The spinning ring according to claim 4, wherein one or both of the foot flange and the web are made of steel.

8. The spinning ring according to claim 1, wherein an insert defining the contact surface and formed of the tungsten sintered material is applied to the ring crown by a soldering process or the ring crown is formed of the tungsten sintered material and is applied to the web by a soldering or welding process.

9. The spinning ring according to claim 1, the spinning ring as a whole is formed from the tungsten sintered material having at least 90% tungsten.

10. A ring/traveler system, comprising:

a ring traveler made of a wire made of high-speed steel (HSS), the ring traveler having a minimum hardness of 60 HRC; and a spinning ring in accordance with claim 1.

11. The ring/traveler system according to claim 10, wherein the high-speed steel corresponds to material 1.3343 according to DIN EN ISO 4957 (2018 November) with the material name HS6.5-2C.

* * * * *